United States Patent [19]

Ostlund et al.

[11] 4,012,316

[45] Mar. 15, 1977

[54] SOLIDS CLASSIFICATION DEVICE

[75] Inventors: Sven E. Ostlund, Stockton; Robert S. Bailey, Sr., Sacramento, both of Calif.

[73] Assignee: Envirotech Corporation, Menlo Park, Calif.

[22] Filed: Apr. 18, 1975

[21] Appl. No.: 569,250

Related U.S. Application Data

[63] Continuation-in-part of Ser. No. 442,716, Feb. 14, 1974, abandoned.

[52] U.S. Cl. ..... 209/10; 209/17; 209/160; 209/173

[51] Int. Cl.[2] ..... B03B 5/28

[58] Field of Search ..... 261/77; 209/17, 156–158, 209/160, 162, 173, 269, 273, 10; 417/84, 179; 239/451, 455

[56] References Cited

UNITED STATES PATENTS

| | | | |
|---|---|---|---|
| 768,095 | 8/1904 | Twist | 239/455 |
| 934,441 | 9/1909 | Hitchcock | 209/161 |
| 1,328,456 | 1/1920 | Ross | 209/166 |
| 1,406,291 | 2/1922 | Shaw | 209/158 |
| 1,497,623 | 6/1924 | Weir | 261/77 |
| 1,627,250 | 5/1927 | Parker | 239/455 |
| 1,890,708 | 12/1932 | White | 417/179 |
| 1,949,354 | 3/1934 | Burnside | 209/158 |
| 2,025,841 | 12/1935 | Young | 209/158 |
| 2,218,507 | 10/1940 | Day | 417/84 |
| 2,250,365 | 7/1941 | Flynn | 209/155 |
| 2,609,240 | 9/1952 | Faulkner et al. | 239/455 |
| 2,921,744 | 1/1960 | Falcetti | 239/276 |
| 2,942,792 | 6/1960 | Anderson et al. | 241/14 |
| 3,154,805 | 10/1964 | Egee et al. | 209/17 |
| 3,249,226 | 5/1966 | Watson | 209/172.5 |
| 3,284,611 | 11/1966 | Laing | 417/84 |
| 3,392,919 | 7/1968 | Wies | 239/455 |
| 3,531,218 | 9/1970 | Warner | 417/85 |
| 3,682,299 | 8/1972 | Conley et al. | 209/158 |

FOREIGN PATENTS OR APPLICATIONS

| | | | |
|---|---|---|---|
| 1,934,364 | 1/1971 | Germany | 209/160 |

*Primary Examiner*—Frank W. Lutter
*Assistant Examiner*—Gregory N. Clements
*Attorney, Agent, or Firm*—Robert E. Krebs; Thomas S. MacDonald

[57] ABSTRACT

A device for hydraulically classifying solid fragments includes two side-by-side liquid-holding compartments between which liquid is continuously circulated; the liquid flows through a flow tube connecting the lower region of the first compartment with the second compartment, then flows upwardly through a throat zone in the first compartment and then over a weir back to the second compartment. The flow tube has a convergent mouth in the second compartment and a divergent outlet in the first compartment. A pump is arranged to withdraw a fraction of the circulating liquid from the second compartment and to inject that liquid into an eductor arranged at the mouth of the flow tube in the second compartment. Solids classification is accomplished at the throat zone: heavier solids sink through the throat zone, and lighter solids are carried upward in the rising current over the weir and onto a drainage screen.

14 Claims, 7 Drawing Figures

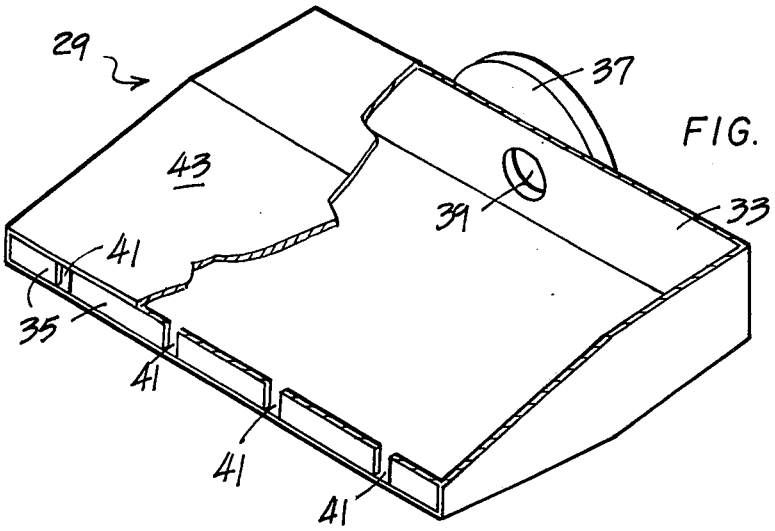
FIG. 3.
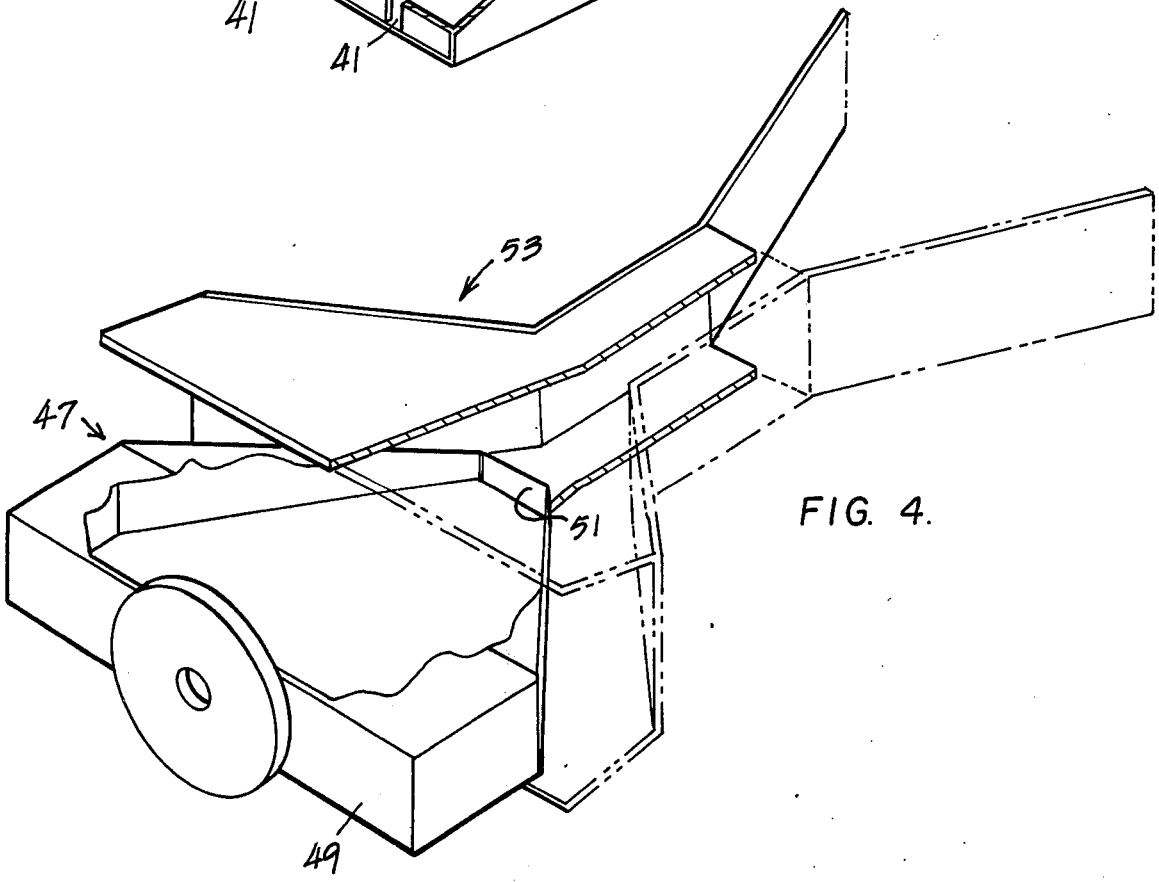
FIG. 4.
FIG. 5.
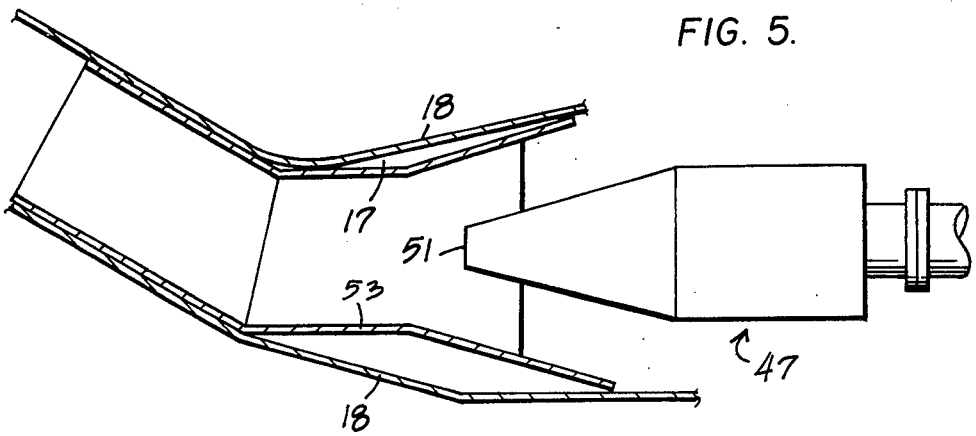

SOLIDS CLASSIFICATION DEVICE

This application is a continuation-in-part of prior copending United States Patent Application Ser. No. 442,716 filed Feb. 14, 1974 now abandoned.

BACKGROUND OF THE INVENTION

1. Field of the Invention

This invention generally relates to a device for hydraulically separating solid fragments according to their densities and, more specifically, to a device for making a density classification of solid fragments by passing the fragments through an upwardly directed flow of liquid.

2. State of the Art

"Wet classification" is a well-known procedure for separating or classifying fragmented solids according to their densities and coarseness. Wet classification devices operate on the principle that coarse particles settle relatively faster in a liquid body than do fine particles of the same specific gravity and, also, that denser particles settle faster than less dense ones. It is well known that if the liquid body is in motion, the differences in settling velocities of the particles becomes more apparent and, thus, sharper size and density separations can be made. In accordance with that knowledge, wet classification devices of the so-called "hydraulic-type" have been developed wherein an upward liquid flow is established and the solids are passed through that flow.

Such classification techniques have been utilized in several fields. For example, hydraulic classification of mineral ore is taught in U.S. Pat. No. 2,250,365 and separation of light gravel from heavier gravel is taught by U.S. Pat. No. 1,949,354. Also, it has been proposed in U.S. Pat. No. 3,682,299 to utilize a rising liquid stream to separate sound gravel from lightweight material. Some of the prior art devices disclose recirculation of the liquid stream.

The prior art devices do not appear, however, to be entirely satisfactory in certain new applications, such as solid waste recycling systems. For such systems to be economical, valuable solid fragments must be effectively separated from worthless solids. For example, wood and plastic and other non-metallic components should be discarded while potentially marketable materials such as aluminum, ferrous metals, copper and zinc should be retained. To accomplish such separations, density classification must be sharper than that which has been heretofore obtained and, if the liquid media is recirculated, provision must be made to avoid clogging of the recirculation means with strings or fibrous strands.

OBJECTS OF THE INVENTION

In accordance with this invention, there is provided a novel and improved device for classifying fragmented solids according to differences in their densities and coarseness. This invention not only overcomes many of the disadvantages of equipment used heretofore, but also provides several significant advantages. A primary object of this invention is to provide a hydraulic separator device having a separation zone wherein an upwardly-flowing liquid has constant, uniform velocity. Another object is to provide liquid circulation means which minimize clogging in a hydraulic separation device.

BRIEF DESCRIPTION OF THE DRAWINGS

Further objects and advantages of the present invention may be readily ascertained from the following description and appended illustrations which are offered by way of example only and not in limitation of the invention whose scope is defined by the appended claims and equivalents. In the drawings:

FIG. 3 is a pictorial view, enlarged for purposes of clarity, of a detail of the device of FIG. 1;

FIG. 4 is a pictorial view, enlarged for purposes of clarity, of a particular modification of the detail shown in FIG. 3;

FIG. 5 is a side elevational view, partially cut away, of the detail shown in FIG. 4;

DESCRIPTION OF THE PREFERRED EMBODIMENT

Figure 1:
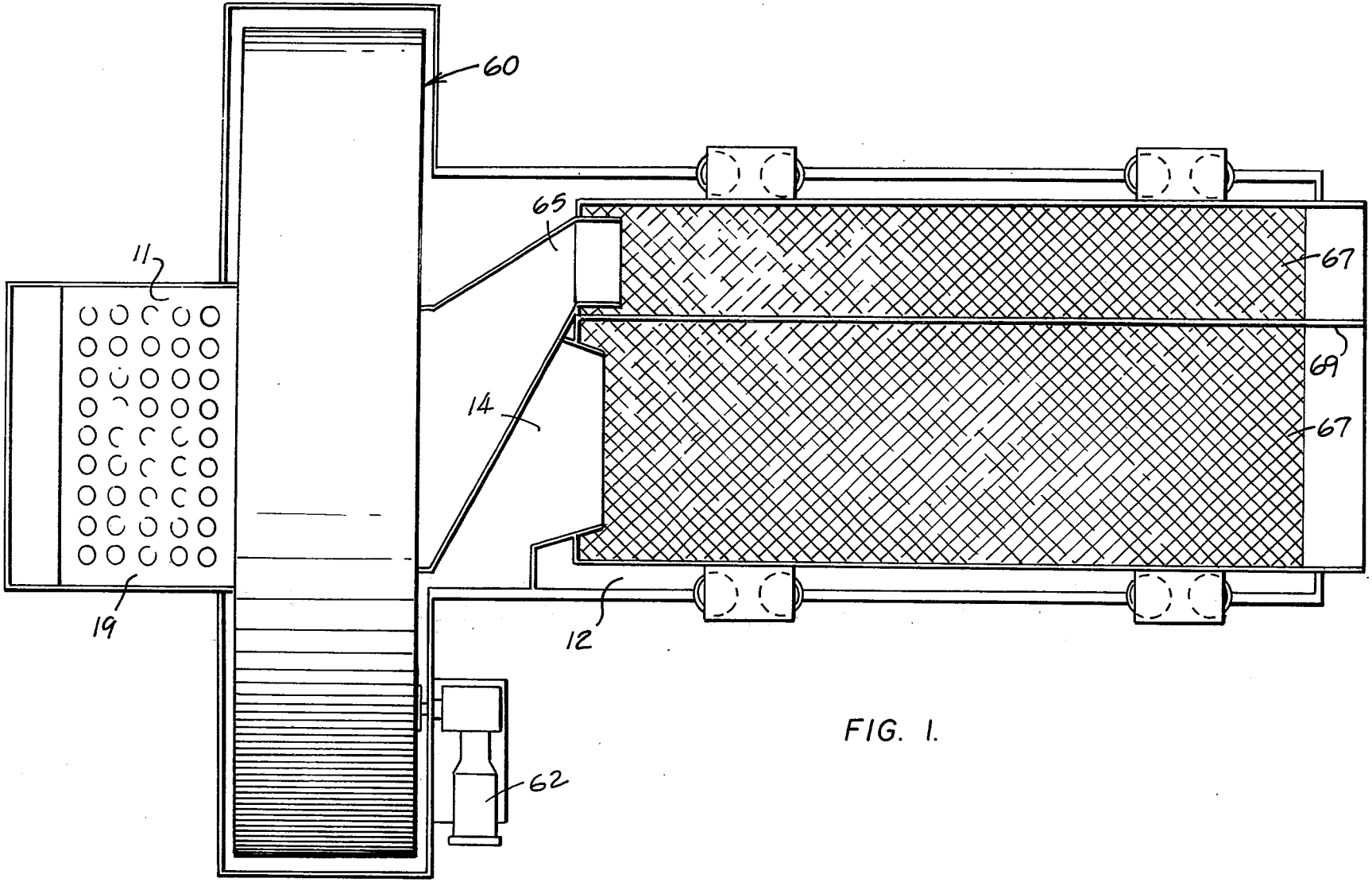
FIG. 1 is a plan view of a classification device according to the invention, some parts of which are omitted for purposes of clarity.
Figure 2:
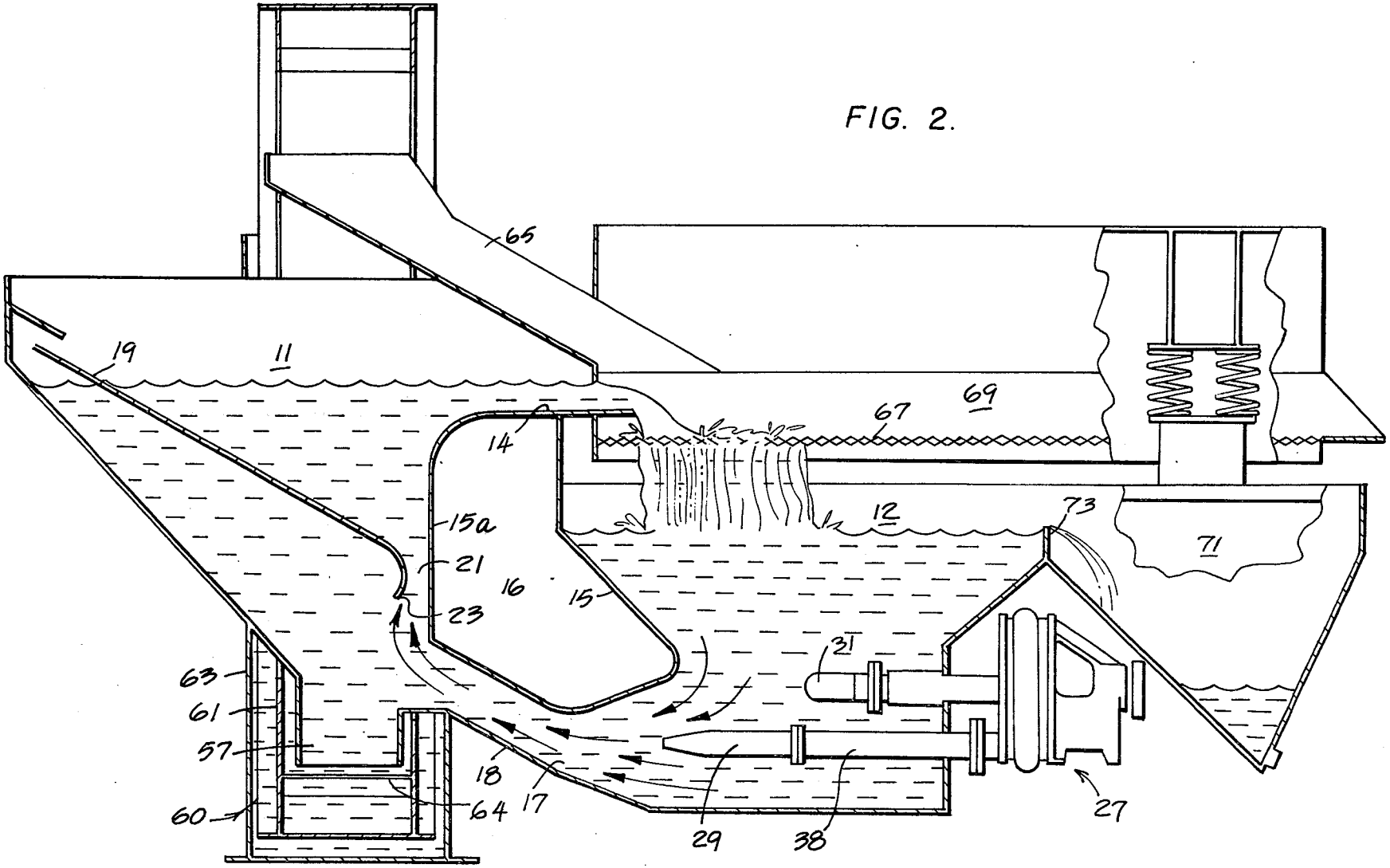
FIG. 2 is a side sectional view of the device of FIG. 1.

The separation device illustrated in FIGS. 1 and 2 includes two side-by-side first and second liquid-holding compartments 11 and 12, respectively, which are separated by a non-foraminous partition 15. Together the two compartments define an open liquid-holding tank which is generally rectangular when viewed from above. The partition 15 defines a dead space 16 and its upper surface serves as a liquid overflow weir 14 between the two compartments. In the first or "separation" compartment 11, the face 15*a* of the partition 15 is smooth and generally vertical.

As shown in FIG. 2, a liquid flow tube 17 is arranged to conduct fluid in the direction indicated by the curved arrows from the lower region of the second compartment into the separation compartment past the partition 15. The illustrated flow tube is generally quadrangular in cross-section and extends beneath the partition 15 contiguous with an upwardly sloping portion 18 of the tank floor. Preferably, the mouth of the flow tube 17 in the second compartment 12 is enlarged and convergent relative to the downstream flow area of the tube. It is also preferred that the outlet of the flow tube in the separation compartment 11 be slightly divergent. With its convergent mouth and divergent outlet, the flow tube 17 has a diffuser or venturi-like configuration.

Above the separation compartment 11, a chute or the like (not shown) is disposed to discharge a stream of fragmented solids onto a downwardly sloping plate 19 which is mounted in the compartment to guide the solids toward the face 15*a* of the partition 15. More specifically, the guide plate 19 extends transversely across the separation compartment 11 and its lower end is spaced from the vertical face 15*a* of the partition to define a throat area 21 through which liquid flows upwardly as indicated by the arrows. The guide plate 19 is preferably mounted so that its slope is selectively adjustable. The lower end of the guide plate usually has a backwardly directed curl 23 so that the flow through the throat area is relatively smooth. The plate may be perforated, as shown, but the perforations should be small enough to prevent the passage of most of the solid fragments.

A pump 27 is mounted outside the second compartment 12 and is constructed and arranged to withdraw a selected fraction of the circulating liquid and then to re-introduce that liquid under pressure into an educator nozzle 29 which is directed into the mouth of the flow tube 17. The pump inlet 31 is preferably located at about the midregion of the second compartment because the liquid there is relatively free from suspended matter, such as strings or strands of material, which could cause clogging. More specifically, the eductor 29 is fixedly mounted in the mouth of the flow tube 17 so that there remains a substantial area for liquid to flow around the nozzle and into the tube. With this arrangement, the high velocity liquid emitted from the nozzle induces flow in the surrounding liquid to achieve circulation of nearly the total liquid mass even though only a fraction of the liquid actually passes through the pump 27. Typically, between 30 and 80 percent of the circulating liquid is drawn through the pump, depending upon the characteristics of the solids feed and the circulating liquid; for reasons of efficiency, it is desirable to minimize the percentage of liquid passing through the pump.

The particular educator nozzle 29 is illustrated in detail in FIG. 3. That nozzle is rectangular in cross-section, has a constant width, and tapers in height from its rear wall 33 to a narrowed forward end 35 which has a plurality of regularly spaced rectangular apertures 41 formed therethrough. A flange member 37 having an aperture 39 is mounted on the rear wall of the eductor for connection to the pump outlet 38 through which liquid is pumped into the eductor. As will be described in more detail hereinafter, the upper wall 43 of the nozzle may be movably hinged so that the size of the discharge outlet can be selectively varied and so that the eductor can be readily opened for cleaning.

A modified eductor 47, shown in FIGS. 4 and 5, is also rectangular in cross-section but tapers both in breadth and in height from its rearward wall 49 to a single rectangular outlet 51. Because of the narrow width of the outlet of this nozzle, it is preferred to mount a flared shroud 53 in the flow tube 17 (see FIG. 5) to decrease the effective flow area and to guide eductor effluent into the flow tube. The walls of the mouth of the shroud 53 are generally parallel to the walls of the nozzle and are sufficiently spaced therefrom to accomodate the flow of a substantial portion of the circulating liquid. Like the flow tube itself, the shroud 53 is rectangular in cross-section and has an expanded outlet and a narrowed intermediate portion to create a diffuser effect.

Referring again to FIGS. 1 and 2, an outlet 57 is formed at the bottom of the separation compartment 11 for the discharge of settled solids or "sink" materials. Arranged in communication with the settled solids outlet is a solids conveying mechanism, generally designated 60, of the well-known drum elevator type; a conventional screw-type conveyor or the like could also be utilized to convey solids from the outlet. Generally speaking, the drum elevator 60 comprises a circular frame 61 which is vertically disposed to encircle the separation compartment 11. The frame is driven to rotate by a motor 62 which engages gears fixed about its periphery. A stationary drum-shaped shell 63 surrounds the frame 61 and is sealingly attached to the separation compartment tank to prevent liquid leakage. On the circumference of the circular frame 61, a plurality of flange-like lifting members 64 are spacedly mounted and positioned to lift sink material from the outlet 57 to a location above the separation compartment 11 as the frame 61 is rotated. After sink material is lifted to an elevated position, it is dropped onto a stationary chute 65 which leads to the vibratory screen 67. Liquid from the sink material drains through the screen and passes back into the system. Vibratory screens are well known; the illustrated screen is constructed such that the solids are moved to discharge at the right-hand end of the machine. It should also be noted that the vibrating screen receives the materials which float over the weir 14 from the first compartment. A divider wall 69 is arranged to divide the screen lengthwise to segregate those float solids from the sink solids.

The illustrated device also includes an optional liquid-holding compartment 71 which is separated from the second compartment by an overflow weir 73. This third compartment 71 is provided to receive finely divided floatable materials which have passed through the vibratory screen 67 into the second compartment.

In the operation of the disclosed machine, solid pieces and fragments are dropped into the separation compartment 11 and are guided toward the throat 21 by the sloping plate 19. Simultaneously, fluid is forced to flow upward through the throat and then over the weir 14 formed by the partition 15 between the two compartments. Separation of the solids is accomplished at the throat 21: the heavier solids settle downwardly through the throat toward the outlet 57 and the lighter solids float over the weir 14 in the circulating liquid. The prime mover for the circulating liquid is the pump 27, but only a fraction of the circulating liquid actually passes through the pump; a substantial fraction of the liquid in circulation is induced to flow by the effect of the educator nozzle 29 which is directed into the convergent mouth of the flow tube 17 that connects the second compartment 12 with the first compartment. The heavy solids which sink into the outlet 57 are thereafter lifted by the drum elevator 60 to the chute 65 and then slide onto the vibrating drainage screen 67. The lighter solids pass over the weir 14 and are also deposited onto the vibratory screen, but on the other side of the dividing wall 67. Makeup liquid can be provided by a liquid spray (not shown) which is positioned to clean the sink material traveling across the vibratory screen.

With respect to the operation of the machine, it is noted that the rectangular configurations of the eductor nozzles disclosed herein in combination with the venturi-like configuration of the quadrangular flow tube 17 alone or in combination with the flared shroud 53 have been found particularly effective in practice to provide a transversely uniform flow pattern of liquid across the separation compartment so that all of the solids in the separation compartment 11 encounter the same hydraulic conditions and, accordingly, to accomplish a sharp classification of solids.

Figure 6:
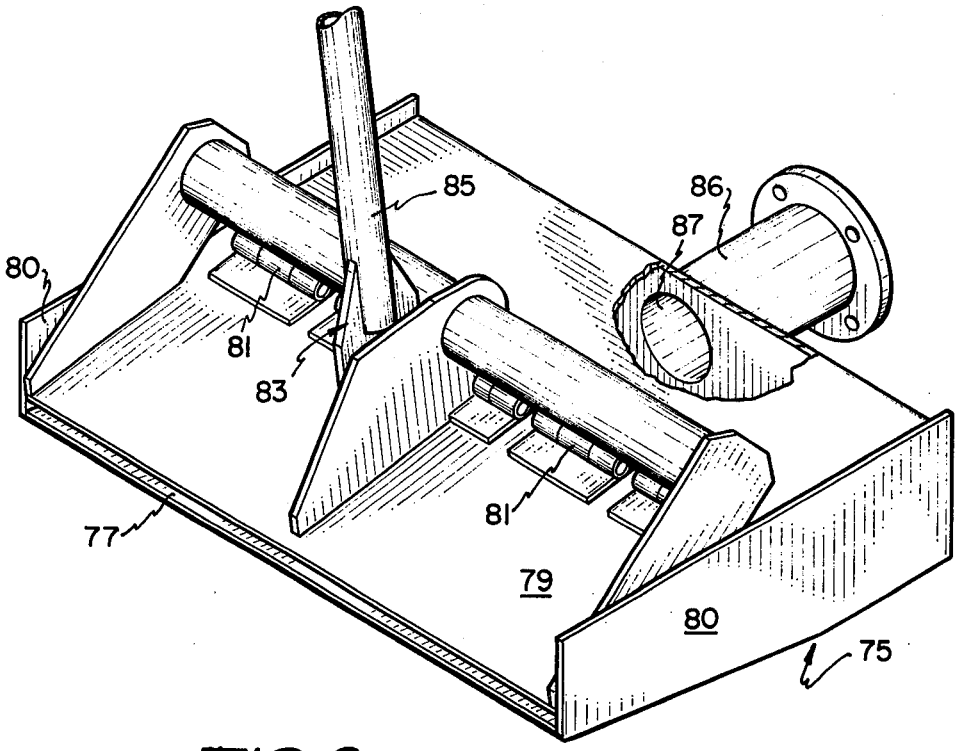
FIG. 6 is a pictorial view, enlarged for purposes of clarity, of another modification of the detail shown in FIG. 3.

FIG. 6 illustrates another modification of an eductor nozzle suitable for utilization in combination with the previously described machine. The nozzle 75 in FIG. 6 is similar to that shown in FIG. 3 in that it also is generally rectangular in cross-section, in that its interior height diminishes toward a narrow outlet 77, in that it includes a movable wall 79 with hinges 81, and in that it includes a connection member 86 to fit the nozzle to the outlet of a pump. The nozzle 75 differs from the one in FIG. 3 in that its sidewalls 80 have substantial height at the discharge end of the nozzle so that the hinged wall 78 can be pivoted to various positions to change the area of the outlet 77 of the nozzle. One advantage of this adjustable nozzle is that the discharge velocity of the liquid emanating from the nozzle can be selectively varied by changing the area of the nozzle outlet, which in turn controls the induced flow through the flow tube and hence the total circulation within the machine.

Figure 7:
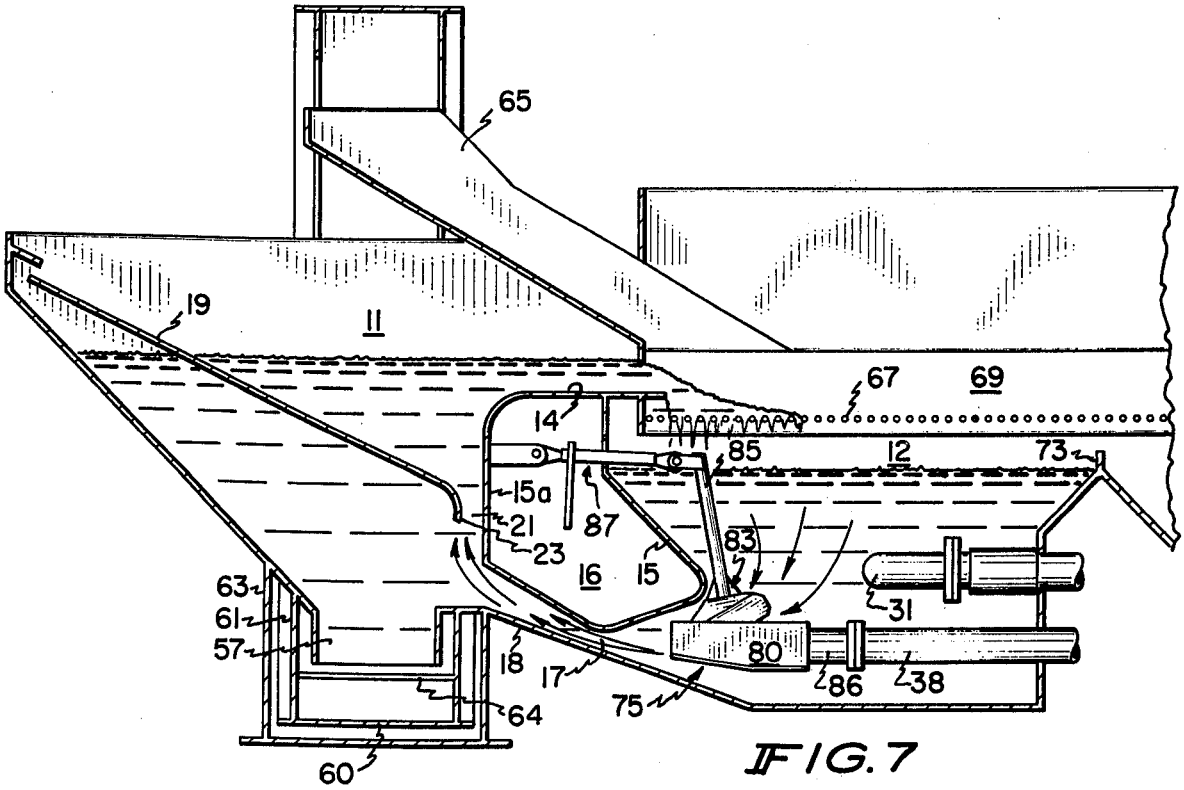
FIG. 7 is a side sectional view of the device of FIG. 1 showing the modification of FIG. 6 incorporated thereinto.

Also in FIGS. 6 and 7, an arm 85 is fixedly connected at one end to the hinged wall 79 and is pivotably connected at its other end to an adjustable bracket assembly 87 fixed to the frame of the machine proper. The bracket assembly can, for example, comprise a turnbuckle-like device which is adjustable in length to pivot the arm 85 and, hence, to change the position of the wall 78. When the turnbuckle is extended the arm 85 pivots in a clockwise direction about the hinges 79 and thereby increases the outlet area 77 of the nozzle 75. It should be appreciated that the illustrated linkage is merely exemplary.

We claim:

1. A device for classifying a stream of solid fragments, comprising:

a. side-by-side first and second liquid-holding compartments separated by a partition wall which is arranged to form a weir between the compartments;

b. a downwardly inclined perforated plate mounted transversely across said first compartment to divide said first compartment into a lower region and a separation compartment above said lower region, the lower edge of said plate being spaced from said partition wall to define therewith a flow throat area to permit liquid flow communication between said lower region and said separation compartment;

c. a flow tube extending through said partition to conduct the liquid from the lower region of said second compartment into said lower region of said first compartment, said flow tube having an enlarged mouth in said second compartment, an outlet in said first compartment and being generally quadrangular in cross-section;

d. a pump having an inlet which is connected into said second compartment to withdraw a fraction of the liquid therefrom;

e. a single eductor nozzle, whose outlet is generally rectangular in cross-section, fixedly connected to the outlet of said pump and arranged at the mouth of said flow tube in said second compartment for receiving the liquid from said pump and for ejecting that liquid into said flow tube so as to induce the liquid which surrounds the eductor to also flow through said flow tube so as to establish a circulation of the liquid between said first and second compartments with the liquid in said first compartment flowing upwardly through said separation compartment and then over said weir, said eductor nozzle being constructed and located relative to said mouth of said flow tube so as to produce a flow pattern of the liquid which has a generally uniform upward velocity transversely across said separation compartment; and f. means for directing a stream of solid fragments for classification into said flow throat area the flow of the liquid through said flow throat area being such that the heavier solids settle through said throat and the lighter solids pass with the liquid over said weir into said second compartment.

2. A device according to claim 1 wherein said outlet of said flow tube in said first compartment is enlarged in area relative to an intermediate neck portion of said flow tube.

3. A device according to claim 1 wherein said eductor nozzle has a rectangular rear wall connected in fluid-flow communication with said pump outlet, and said nozzle also has side walls which taper in height from said rear wall to a relatively narrow forward end.

4. The device according to claim 3 wherein the outlet end of said eductor nozzle comprises a series of rectangular apertures spaced apart across the width of said nozzle.

5. The device according to claim 3 wherein said eductor nozzle tapers in height as well as width from said rear wall and the outlet end comprises a single rectangular aperture.

6. The device according to claim 1 wherein a vibratory drainage screen is arranged over said second compartment to receive solids which have passed over said weir from said first compartment.

7. A device according to claim 6 further including means to remove settled solids from said first compartment and to deposit said solids onto said drainage screen and means to segregate the settled solids from the other said solids on said screen.

8. A device according to claim 7 including a third liquid-holding compartment separated from said second compartment by a liquid overflow weir.

9. The device according to claim 1 wherein said flow tube is constructed and arranged to slope upwardly from said second compartment to said first compartment.

10. A device according to claim 1 wherein said inlet of said pump is constructed and arranged to withdraw the liquid from the midregion of said second compartment.

11. A device according to claim 1 wherein a wall portion of said eductor nozzle is movably hinged for adjustment of the area of the outlet of said nozzle.

12. A device for classifying a stream of solid fragments, comprising:

a. side-by-side first and second liquid-holding compartments separated by a partition which is arranged to form a weir between the compartments;

b. a perforated plate disposed in said first compartment to divide said first compartment into a lower region and a separation compartment above said lower region, said plate containing a flow throat area to permit liquid flow communication between said lower region and said separation compartment; and c. a flow tube extending through said partition to conduct the liquid from the lower region of said second compartment into said first compartment, said flow tube having an enlarged mouth in said second compartment, an outlet in said first compartment and being generally quadrangular in cross-section;

d. a pump having an inlet which is connected into said second compartment to withdraw a fraction of the liquid therefrom;

e. a single adjustable eductor, having an outlet which is generally rectangular in cross-section and of adjustable area, fixedly connected to the outlet of said pump and arranged at the mouth of said flow tube in said second compartment for receiving the liquid from said pump and for ejecting that liquid into said flow tube so as to induce the liquid which surrounds the eductor to also flow through said flow tube so as to establish a circulation of the liquid between said first and second compartments with the liquid in said first compartment flowing upwardly through said separation compartment and then over said weir, said eductor nozzle being constructed and located relative to said mouth of said flow tube so as to produce a flow pattern of the liquid which has a generally uniform upward velocity transversely across said separation compartment; and f. means for directing a stream of solid fragments for classification into said flow throat area the flow of the liquid through said flow throat area being such that the heavier solids settle through said throat and the lighter solids pass with the liquid over said weir into said second compartment.

13. A device according to claim 12 wherein a wall portion of said eductor is movably hinged for adjustment of the outlet area of said eductor.

14. A device according to claim 13 further including linkage connected at its one end to said movable wall portion and connected at its other end to means isolated from the liquid in said second compartment to adjust the position of said movable wall portion.

* * * * *